US005529871A

United States Patent [19]

Ichimura et al.

[11] Patent Number: 5,529,871

[45] Date of Patent: Jun. 25, 1996

[54] COLOR TONER AND PROCESS FOR PRODUCING THE SAME

[75] Inventors: Masanori Ichimura; Hiroshi Takayama; Michio Take; Hideyuki Akagi; Takashi Imai; Satoshi Inoue; Yasuo Yamamoto; Yutaka Sugizaki; Koji Fukushima; Masayuki Takei; Masaru Miura, all of Kanagawa, Japan

[73] Assignee: Fuji Xerox Co., Ltd., Tokyo, Japan

[21] Appl. No.: 276,488

[22] Filed: Jul. 18, 1994

Related U.S. Application Data

[63] Continuation of Ser. No. 882,002, May 13, 1992, abandoned, which is a continuation-in-part of Ser. No. 710,620, Jun. 5, 1991, abandoned.

[30] Foreign Application Priority Data

Jun. 6, 1990 [JP] Japan ..... 2-146251
May 14, 1991 [JP] Japan ..... 3-137049

[51] Int. Cl.$^6$ ..... G03G 9/00

[52] U.S. Cl. ..... 430/106; 430/137

[58] Field of Search ..... 430/106, 137

[56] References Cited

U.S. PATENT DOCUMENTS 4,865,937 9/1989 Santilli et al. ..... 430/106
5,262,268 11/1993 Bertrand et al. ..... 430/137

FOREIGN PATENT DOCUMENTS 62-127847 6/1987 Japan .

*Primary Examiner*—Mark Chapman
*Attorney, Agent, or Firm*—Finnegan, Henderson, Farabow, Garrett & Dunner

[57] ABSTRACT

A color toner providing a toner image excellent in brightness, clearness and graininess and a process for producing the same are disclosed, wherein a proportion of dispersed pigment particles having a circle-equivalent diameter of 0.3 μm or greater does not exceed 0.1% of the total number of said dispersed pigment particles. The process comprises kneading a water-containing pigment paste and a binder resin at a temperature of 100° C. or higher under pressure in a heat and pressure kneader to remove a water content to obtain a pigment dispersion, melt-kneading the resulting pigment dispersion together with a binder resin, and grinding the mixture.

9 Claims, No Drawings

COLOR TONER AND PROCESS FOR PRODUCING THE SAME

This application is a continuation of application Ser. No. 07/882,002 filed May 13, 1992, now abandoned, which is a continuation-in-part of application Ser. No. 07/710,620, filed Jun. 5, 1991, now abandoned.

FIELD OF THE INVENTION

This invention relates to a color toner and a process for producing the same.

BACKGROUND OF THE INVENTION

In electrophotography, color image formation is based on a three-color process such as a subtractive color process and generally consists of forming at least three electrostatic latent images, developing the latent images with at least three different color toners, and reproducing the original color on copying paper. Requirements for the color toners used here are severer than in black-and-white development. That is, the toners are demanded to have mechanical and electrical stability against such external factors as shocks and humidity, proper color developability, and color preservability.

Conventional processes for producing full color toners mostly comprise melt-kneading a colorant and a binder resin, grinding, and classifying to obtain particles of a prescribed size. Where a pigment is used as a colorant, since it undergoes agglomeration on drying, re-grinding or any other means for size reduction is required. To improve this, it has been proposed to prepare a toner by a process comprising incorporating an aqueous dispersion of finely divided pigment particles obtained by an acid paste process or an acid slurry process into an organic solvent solution of a binder resin, heat treating the mixture, and mixing the resulting pigment dispersed-resin with a binder resin as disclosed in JP-A-62- 127847 (the term "JP-A" as used herein means an "unexamined published Japanese patent application").

However, the proposed process turned out to result in insufficient brightness and clearness of an image. This disadvantage is particularly conspicuous when a toner image is formed on an over-head-projector sheet (OHP sheet) to obtain a projected image. In order to obtain a distinct color image, particularly a Victorian full color image, by overlapping several color toner images, a magenta toner, a yellow toner, and-a cyan toner are overlaid one after another and fused together to obtain a second-order color and then a third-order color. For example, where a second-order color is formed by overlaying two color toners, a color difference between a theoretical second-order color and the second-order color actually obtained is decided by transparency of the toner layers. When at least the upper toner layer has satisfactory transparency, the light reflected on the lower ink layer(s) is close to that of the second-order color assigned to the characteristics of the pigments themselves to achieve satisfactory color reproduction. However, sufficient transparency could not be obtained with conventional toner materials, failing to obtain a satisfactory overlaid image.

On the other hand, in the production of full color toners, various attempts have been made to obtain excellent graininess for a half tone of a digital image, and use of toner particles having a diameter of not more than 8 μm has been proposed. In this case, however, the effect of improving graininess is small with high pigment concentrations.

SUMMARY OF THE INVENTION

Accordingly, an object of the present invention is to provide a color toner which forms a toner image excellent in brightness, clearness, and graininess.

Another object of the present invention is to provide a color toner capable of reproducing a distinct color image.

As a result of extensive studies, the inventors have found that the above objects of the present invention are accomplished by controlling a dispersion state and an amount of a pigment contained in a toner within specific ranges.

The present invention relates to a color toner comprising a binder resin having dispersed therein pigment particles, wherein a proportion of dispersed pigment particles having a circle-equivalent diameter of 0.3 μm or greater does not exceed 0.1% of the total number of said dispersed pigment particles.

It is preferable that the color toner of the present invention has a pigment content ranging from 2 to 8 parts by weight per 100 parts by weight of the binder resin and has an absorbance satisfying formula:

$$A \geqq 0.3B+0.1$$

wherein A is an absorbance; and B is a number of parts by weight of the pigment per 100 parts by weight of the binder resin.

It is more preferable that the toner particles have a diameter of not more than 9 μm, and the pigment content is from 2 to 5.5 parts by weight per 100 parts by weight of the binder resin.

The present invention further relates to a process for producing a color toner comprising kneading a water-containing pigment paste and a binder resin at a temperature of 100° C. or higher in a pressure kneader to remove a water content to obtain a pigment dispersion, melt-kneading the resulting pigment dispersion together with a binder resin, and grinding the mixture.

DETAILED DESCRIPTION OF THE INVENTION

The "circle-equivalent diameter" of pigment particles is measured by slicing a color toner comprising a binder resin having dispersed therein pigment particles with a microtome, taking micrographs of the slice at a magnification of 600 by means of an optical microscope and at a magnification of 4300 and 2500 by means of a transmission electron microscope, and analyzing the micrographs with an image analyzer, for example, Omnicon 3500 manufactured by Shimadzu Corporation.

The terminology "absorbance" as used herein means an absorbance measured as follows. A color toner comprising a binder resin having dispersed therein pigment particles is uniformly scattered on an OHP sheet and then heated to be sufficiently fused to form a smooth color toner layer having a thickness of 5 μm. A maximum absorbance of the resulting color toner layer in a wavelength region of from 380 to 700 nm is measured by means of a general absorbance measuring device (e.g., Autographic Spectrophotometer U-3210 manufactured by Hitachi, Ltd.).

In the color toner according to the present invention, a pigment must be dispersed in a binder resin as finely divided particles so that a proportion of dispersed pigment particles having a circle-equivalent diameter of 0.3 μm or greater may not exceed 0.1% of the total number of said dispersed pigment particles. If the proportion of particles of 0.3 μm or greater exceeds 0.1%, the absorbance is reduced with the pigment concentration being equal, resulting in reduction in brightness and clearness of a projected image. It is most preferred that the binder resin for use in the present invention does not contain pigment particles having a circle-equivalent diameter of 0.3 μm or greater.

In a preferred embodiment of the above-specified color toner, the pigment content ranges from 2 to 8 parts by weight per 100 parts by weight of the binder resin, and the absorbance satisfies formula:

$$A \geqq 0.3B+0.1$$

wherein A is an absorbance; and B is a number of parts by weight of the pigment per 100 parts by weight of the binder resin.

When the above formula is not satisfied, the resulting toner image tends to have insufficient brightness or clearness.

Pigments which can be used in the present invention typically include C.I. Pigment Red 48:1, C.I. Pigment Red 122, C.I. Pigment Red 57:1, C.I. Pigment Yellow 97, C.I. Pigment Yellow 12, C.I. Pigment Yellow 17, C.I. Pigment Blue 15:1, and C.I. Pigment Blue 15:3.

The color toner of the present invention preferably has a pigment content of from 2 to 8 parts per 100 parts by weight of a binder resin. If the pigment content is less than 2 parts, a coloring power becomes weak. If it exceeds 8 parts, transparency of the color toner is deteriorated. A preferred pigment content is from 2 to 5.5 parts per 100 parts by weight of a binder resin. A particularly preferred pigment content is from 3 to 5.5 parts per 100 parts by weight of a binder resin. With the pigment content being in the particularly preferred range, image graininess of a half tone of the color toner can be markedly improved.

Known binder resins can be used in the color toner of the present invention. Examples of suitable binder resins include homo- or copolymers of styrene or a derivative thereof, e.g., vinyltoluene, α-methylstyrene, chlorostyrene, and aminostyrene; homo- or copolymers of methacrylic acid or an ester thereof, e.g., methyl methacrylate, ethyl methacrylate, and butyl methacrylate; homo- or copolymers of acrylic acid or an ester thereof, e.g., methyl acrylate, ethyl acrylate, butyl acrylate, and 2-ethylhexyl acrylate; homopolymers of vinyl monomers such as dienes (e.g., butadiene, isoprene), acrylonitrile, vinyl ethers, maleic acid or an ester thereof, maleic anhydride, vinyl chloride, and vinyl acetate, or copolymers of such a vinyl monomer and other comonomers; homo- or copolymers of olefins, e.g., ethylene and propylene; polyesters, polyamides, and polyurethanes. These binder resins may be used either individually or in combination of two or more thereof.

Of these binder resins, preferred are polyester resins and styrene-acrylate resins. More preferred are (1) linear polyesters obtained from terephthalic acid, a bisphenol A-ethylene oxide adduct, and cyclohexanedimethanol and having a softening point (Tm) of from 100° to 125° C., a glass transition point (Tg) of from 55° to 68° C., a number-average molecular weight (Mn) of $(3.3\pm0.3)\times10^3$, a weight-average molecular weight (Mw) of $(9.1\pm0.4)\times10^3$, an acid value (AV) of from 6 to 125, and a hydroxyl value (OHV) of from 25 to 40 and (2) styrene/butyl methacrylate copolymers having a Tm of from 110° to 135° C., a Tg of from 55° to 70° C., an Mn of $(1.7\pm0.3)\times10^4$, and an Mw of $(3.6\pm0.4)\times10^4$.

The physical properties of the binder resins were measured with the following measuring instruments:

Tm . . . Koka-type flow tester, FT-500 manufactured by Shimadzu Corporation.

Tg . . . Differential scanning calorimeter, DT-30 manufactured by Shimadzu Corporation. (an inflection point is taken as a Tg.)

Mn, Mw . . . Gel-permeation chromatograph, HLC-802A manufactured by Tosoh Corporation.; solvent: tetrahydrofuran Charge control of toner particles may be effected by appropriate selection of binder resins and/or pigments. If desired, a charge control agent may be used in combination unless such interferes with color reproduction. As the charge control agent, known and marketed colorless charge control agents can be used in the present invention. Typical examples thereof include ion structure substance such as cetylpyridinium chloride and tetraphenyl carbonate potassium salt, non-dye series metal complexes, Bontron E-82, E-84 and E-88 (manufactured by Orient Kagaku Kogyo K.K.), and compounds having the following structure

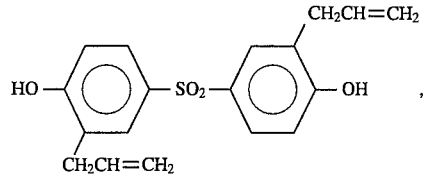

, and

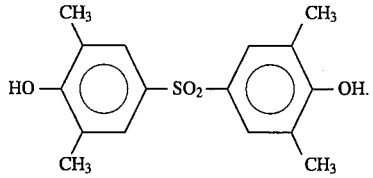

The charge control agent may be used either as incorporated with a binder resin or as adhered on the surface of toner particles.

The color toner of the present invention can be produced as follows. A water-containing pigment paste (water content: 40–80%) is kneaded under heat together with a binder resin at a temperature of at least 100° C. in a heat kneader to remove a water content. The time of kneading is preferably at least 30 minutes. More preferably, kneading is carried out at a temperature of from 100° to 110° C. for 50 to 200 minutes. It is preferable to apply pressure during the kneading. In this case, the time of kneading is preferably at least 1 minute. More preferably, kneading is carried out at a temperature of from 100° to 110° C. for 5 to 10 minutes. The pressure during the kneading is preferably 1 kg/cm$^2$ or higher, more preferably from 2 to 10 kg/cm$^2$. The thus obtained pigment dispersion is then melt-kneaded with a binder resin, cooled, and classified. There is thus obtained a toner having a pigment content of, e.g., 3 to 5.5% by weight, and a particle size of, e.g., not more than 9 μm, preferably 5 to 8 μm.

The present invention is now illustrated in greater detail with reference to Preparation Examples, Examples, and Comparative Examples, but it should be understood that the present invention is not deemed to be limited thereto. All the percents, parts, and ratios are by weight unless otherwise indicated.

In these Examples, the following binder resins were used.

Polyester Resin (Resin A):

A linear polyester resin obtained from terephthalic acid/bisphenol A ethylene oxide adduct/cyclohexanedimethanol having a Tm of 110° C., a Tg of 63° C., an Mn of 3200, an Mw of 9200, an AV of 9, and an OHV of 33.

Styrene-Acrylate Resin (Resin B):

A styrene/butyl methacrylate copolymer having a Tm of 120° C., a Tg of 65° C., an Mn of 16000; and an Mw of 35000.

PREPARATION EXAMPLE 1

To 3.5 kg of resin A was added 3.75 kg of a water-containing paste (water content: 60%) of copper-phthalocyanine (C.I. Pigment Blue 15:3) obtained in a pigment grinding stage, and the mixture was kneaded in a heat and pressure kneader at a temperature of 105° C. and a pressure of 4 kg/m$^2$ for 10 minutes to obtain a cyan pigment dispersion having a pigment content of 30%.

Pigment particles in the resulting cyan pigment dispersion had a particle diameter falling within a range of from 0.05 to 0.15 μm and were dispersed very uniformly.

PREPARATION EXAMPLE 2

To 3.5 kg of resin B was added 3.75 kg of a water-containing paste (water content: 60%) of copper-phthalocyanine (C.I. Pigment Blue 15:3) obtained in a paste grinding stage, and the mixture was kneaded in a heat and pressure kneader at 105° C. and at a pressure of 5 kg/m$^2$ for 10 minutes to obtain a cyan pigment dispersion having a pigment content of 30%.

Pigment particles in the resulting cyan pigment dispersion had a particle diameter falling within a range of from 0.05 to 0.15 μm and were dispersed very uniformly.

PREPARATION EXAMPLE 3

To a 3.5 kg of resin A was added 3.75 kg of a water-containing paste of Carmine 6B (C.I. Pigment Red 57:1) obtained in a pigment grinding stage, and the mixture was kneaded in a heat and pressure kneader at 110° C. and a pressure of 6 kg/m$^2$ for 15 minutes to obtain a magenta pigment dispersion having a pigment content of 30%.

Pigment particles in the dispersion had a particle diameter falling within a range of from 0.02 to 0.1 μm and were dispersed very uniformly.

PREPARATION EXAMPLE 4

To a 3.5 kg of resin B was added 3.75 kg of a water-containing paste of Carmine 6B (C.I. Pigment Red 57:1) obtained in a pigment grinding stage, and the mixture was kneaded in a heat and pressure kneader at 110° C. and a pressure of 6 kg/m$^2$ for 15 minutes to obtain a magenta pigment dispersion having a pigment content of 30%.

Pigment particles in the dispersion had a particle diameter falling within a range of from 0.05 to 0.1 μm and were dispersed very uniformly.

PREPARATION EXAMPLE 5

To a 3.5 kg of resin A was added 3.75 kg of a water-containing paste of dimethylquinacridone (C.I. Pigment Red 122) obtained in a pigment grinding stage, and the mixture was kneaded in a heat and pressure kneader at 100° C. and a pressure of 3 kg/m$^2$ for 10 minutes to obtain a magenta pigment dispersion having a pigment content of 30%.

Pigment particles in the dispersion had a particle diameter falling within a range of from 0.05 to 0.2 μm and were dispersed very uniformly.

PREPARATION EXAMPLE 6

To a 3.5 kg of resin A was added 3.75 kg of a water-containing paste of Rhodamine 66 Lake (C.I. Pigment Red 81) obtained in a pigment grinding stage, and the mixture was kneaded in a heat and pressure kneader at 105° C. and a pressure of 5 kg/m$^2$ for 10 minutes to obtain a magenta pigment dispersion having a pigment content of 30%.

Pigment particles in the dispersion had a particle diameter falling within a range of from 0.05 to 0.1 μm and were dispersed very uniformly.

PREPARATION EXAMPLE 7

To a 3.5 kg of resin A was added 3.75 kg of a water-containing paste of Disazo Yellow (C.I. Pigment Yellow 17) obtained in a pigment grinding stage, and the mixture was kneaded in a heat and pressure kneader at 105° C. and a pressure of 4 kg/m$^2$ for 5 minutes to obtain a yellow pigment dispersion having a pigment content of 30%.

Pigment particles in the dispersion had a particle diameter falling within a range of from 0.05 to 0.15 μm and were dispersed very uniformly.

PREPARATION EXAMPLE 8

To a 3.5 kg of resin B was added 3.75 kg of a water-containing paste of Disazo Yellow (C.I. Pigment Yellow 17) obtained in a pigment grinding stage, and the mixture was kneaded in a heat and pressure kneader at 105° C. and a pressure of 6 kg/m$^2$ for 5 minutes to obtain a yellow pigment dispersion having a pigment content of 30%.

Pigment particles in the dispersion had a particle diameter falling within a range of from 0.05 to 0.15 μm and were dispersed very uniformly.

PREPARATION EXAMPLE 9

To a 3.5 kg of resin A was added 3.75 kg of a water-containing paste of Monoazo Yellow (C.I. Pigment Yellow 97) obtained in a pigment grinding stage, and the mixture was kneaded in a heat and pressure kneader at 105° C. and a pressure of 3 kg/m$^2$ for 10 minutes to obtain a yellow pigment dispersion having a pigment content of 30%.

Pigment particles in the dispersion had a particle diameter falling within a range of from 0.1 to 0.3 μm and were dispersed very uniformly.

PREPARATION EXAMPLE 10

To a 3.5 kg of resin B was added 3.75 kg of a water-containing paste (water content: 60%) of copper-phthalocyanine (C.I. Pigment Blue 15:3) obtained in a pigment grinding stage, and the mixture was kneaded in a heat and pressure kneader at 105° C. and no pressure for 60 minutes to obtain a cyan pigment dispersion having a pigment content of 30%.

Pigment particles in the resulting cyan pigment dispersion had a particle diameter falling within a range of from 0.05 to 0.15 μm and were dispersed very uniformly.

PREPARATION EXAMPLE 11

To a 3.5 kg of resin A was added 3.75 kg of a water-containing paste of dimethylquinacridone (C.I. Pigment Red 122) obtained in a pigment grinding stage, and the mixture was kneaded in a heat and pressure kneader at 100° C. and no pressure for 60 minutes to obtain a magenta pigment dispersion having a pigment content of 30%.

Pigment particles in the resulting magenta pigment dispersion had a particle diameter falling within a range of from 0.05 to 0.2 μm and were dispersed very uniformly.

EXAMPLE 1

Resin A (88.3 parts) and 16.7 parts of the magenta pigment dispersion obtained in Preparation Example 3 were mixed, kneaded, and ground to prepare toner particles having an average particle size of 7 μm. To 100 parts of the toner particles was added 0.3 part of silica particles (R 972, produced by Nippon Aerosil K.K.) to obtain a magenta toner.

In the resulting magenta toner, the proportion of dispersed particles having a circle-equivalent diameter of 0.3 μm or more was 0%. A 5 μm thick toner layer of the resulting toner had an absorbance of 2.2.

Five parts of the magenta toner and 100 parts of a coated ferrite carrier having a particle size of 50 μm were mixed to prepare a developer.

A toner image was formed on OHP sheets using a full color copying machine, FX 6800 manufactured by Fuji Xerox Co., Ltd., and the thus prepared developer. The OHP sheets were projected by means of an over-head-projector to give a transparent image of high saturation.

EXAMPLE 2

A magenta toner was prepared in the same manner as in Example 1, except for changing the amounts of resin A and magenta pigment dispersion to 95.3 parts and 10 parts, respectively.

In the resulting magenta toner, the proportion of dispersed particles having a circle-equivalent diameter of 0.3 μm or more was 0%. A 5 μm thick toner layer of the resulting toner had an absorbance of 1.0.

Copying was conducted in the same manner as in Example 1. The toner image on OHP sheets gave a projected image of high saturation and high transparency.

EXAMPLE 3

A magenta toner was prepared in the same manner as in Example 1, except for changing the amounts of resin A and magenta pigment dispersion to 81.3 parts and 13.3 parts, respectively.

In the resulting magenta toner, the proportion of dispersed particles having a circle-equivalent diameter of 0.3 μm or more was 0%. A 5 μm thick toner layer of the resulting toner had an absorbance of 1.7.

Copying was conducted in the same manner as in Example 1. The toner image on OHP sheets gave a projected image of high saturation and high transparency.

EXAMPLE 4

Resin B (88.3 parts) and 16.7 parts of the magenta pigment dispersion obtained in Preparation Example 4 were mixed, kneaded, and ground to prepare magenta toner particles having an average particle size of 7 μm. To 100 parts of the toner particles was added 0.3 part of silica particles (R 972, produced by Nippon Aerosil K.K.) to obtain a magenta toner.

In the resulting magenta toner, the proportion of dispersed particles having a circle-equivalent diameter of 0.3 μm or more was 0%. A 5 μm thick toner layer of the resulting toner had an absorbance of 2.2.

A developer was prepared, and copying was conducted in the same manner as in Example 1. The image on OHP sheets gave a projected image of high saturation and high transparency.

EXAMPLE 5

A cyan toner was prepared in the same manner as in Example 1, except for replacing the magenta pigment dispersion with the cyan pigment dispersion obtained in Preparation Example 1.

In the resulting cyan toner, the proportion of dispersed particles having a circle-equivalent diameter of 0.3 μm or more was 0%. A 5 μm thick toner layer of the resulting toner had an absorbance of 1.9.

Copying was conducted in the same manner as in Example 1. The image on OHP sheets gave a projected image of high saturation and high transparency.

EXAMPLE 6

A cyan toner was prepared in the same manner as in Example 4, except for replacing the magenta pigment dispersion with the cyan pigment dispersion obtained in Preparation Example 2.

In the resulting cyan toner, the proportion of dispersed particles having a circle-equivalent diameter of 0.3 μm or more was 0.1%. A 5 μm thick toner layer of the resulting toner had an absorbance of 1.8.

Copying was conducted in the same manner as in Example 1. The image on OHP sheets gave a projected image of high saturation and high transparency.

EXAMPLE 7

A magenta toner was prepared in the same manner as in Example 1, except for replacing the magenta pigment dispersion as used in Example 1 with the magenta pigment dispersion obtained in Preparation Example 5.

In the resulting magenta toner, the proportion of dispersed particles having a circle-equivalent diameter of 0.3 μm or more was 0%. A 5 μm thick toner layer of the resulting toner had an absorbance of 2.0.

Copying was conducted in the same manner as in Example 1. The image on OHP sheets gave a projected image of high saturation and high transparency.

EXAMPLE 8

A magenta toner was prepared in the same manner as in Example 1, except for replacing the magenta pigment dispersion as used in Example 1 with the magenta pigment dispersion obtained in Preparation Example 6.

In the resulting magenta toner, the proportion of dispersed particles having a circle-equivalent diameter of 0.3 μm or more was 0%. A 5 μm thick toner layer of the resulting toner had an absorbance of 2.4.

Copying was conducted in the same manner as in Example 1. The image on OHP sheets gave a projected image of high saturation and high transparency.

EXAMPLE 9

A yellow toner was prepared in the same manner as in Example 1, except for replacing the magenta pigment dispersion as used in Example 1 with the yellow pigment dispersion obtained in Preparation Example 7.

In the resulting yellow toner, the proportion of dispersed particles having a circle-equivalent diameter of 0.3 μm or more was 0.08%. A 5 μm thick toner layer of the resulting toner had an absorbance of 2.0.

Copying was conducted in the same manner as in Example 1. The image on OHP sheets gave a projected image of high saturation and high transparency.

EXAMPLE 10

A yellow toner was prepared in the same manner as in Example 1, except for replacing the magenta pigment dispersion as used in Example 1 with the yellow pigment dispersion obtained in Preparation Example 8.

In the resulting yellow toner, the proportion of dispersed particles having a circle-equivalent diameter of 0.3 μm or more was 0.08%. A 5 μm thick toner layer of the resulting toner had an absorbance of 1.6.

Copying was conducted in the same manner as in Example 1. The image on OHP sheets gave a projected image of high saturation and high transparency.

EXAMPLE 11

A yellow toner was prepared in the same manner as in Example 1, except for changing the amount of resin A to 95.3 parts and replacing the magenta pigment dispersion with the yellow pigment dispersion obtained in Preparation Example 9.

In the resulting yellow toner, the proportion of dispersed particles having a circle-equivalent diameter of 0.3 μm or more was 0.05%. A 5 μm thick toner layer of the resulting toner had an absorbance of 1.6.

When copying was conducted in the same manner as in Example 1, the image on OHP sheets gave a projected images of high saturation and high transparency.

EXAMPLE 12

A yellow toner was prepared in the same manner as in Example 4, except for replacing the magenta pigment dispersion with the yellow pigment dispersion obtained in Preparation Example 8.

In the resulting yellow toner, the proportion of dispersed particles having a circle-equivalent diameter of 0.3 μm or more was 0.1%. A 5 μm thick toner layer of the resulting toner had an absorbance of 2.0.

Copying was conducted in the same manner as in Example 1. The image on OHP sheets gave a projected image of high saturation and high transparency.

EXAMPLE 13

A cyan toner was prepared in the same manner as in Example 1, except for replacing the magenta pigment dispersion with the cyan pigment dispersion obtained in Preparation Example 10.

In the resulting cyan toner, the proportion of dispersed particles having a circle-equivalent diameter of 0.3 μm or more was 0%. A 5 μm thick toner layer of the resulting toner had an absorbance of 1.9.

Copying was conducted in the same manner as in Example 1. The image on OHP sheets gave a projected image of high saturation and high transparency.

EXAMPLE 14

A magenta toner was prepared in the same manner as in Example 1, except for replacing the magenta pigment dispersion with the magenta pigment dispersion obtained in Preparation Example 11.

In the resulting magenta toner, the proportion of dispersed particles having a circle-equivalent diameter of 0.3 μm or more was 0%. A 5 μm thick toner layer of the resulting toner had an absorbance of 2.0.

Copying was conducted in the same manner as in Example 1. The image on OHP sheets gave a projected image of high saturation and high transparency.

COMPARATIVE EXAMPLE 1

Resin A (100 parts) and 5 parts of Carmine 6B pigment (Symuler Brilliant Carmine 6B 246, produced by Dainippon Ink & Chemicals, Inc.) were mixed, kneaded, and ground to prepare toner particles having an average particle size of 7 μm. To 100 parts of the toner particles was added 0.3 part of silica particles (R 972, produced by Nippon Aerosil K.K.) to obtain a magenta toner.

In the resulting magenta toner, the proportion of dispersed particles having a circle-equivalent diameter of 0.3 μm or more was 2.5%. A 5 μm thick toner layer of the resulting toner had an absorbance of 0.9.

A developer was prepared, and copying was conducted in the same manner as in Example 1. The OHP sheets were projected to give a dull image of low saturation.

COMPARATIVE EXAMPLE 2

A magenta toner was prepared in the same manner as in Comparative Example 1, except for changing the amount of Carmine 6B pigment to 3 parts.

In the resulting magenta toner, the proportion of dispersed particles having a circle-equivalent diameter of 0.3 μm or more was 3.2%. A 5 μm thick toner layer of the resulting toner had an absorbance of 0.5.

A developer was prepared, and copying was conducted in the same manner as in Example 1. The resulting image had a weak coloring power and was dull.

COMPARATIVE EXAMPLE 3

A magenta toner was prepared in the same manner as in Example 1, except for changing the amounts of resin A and the magenta pigment dispersion to 80 parts and 20 parts, respectively.

In the resulting magenta toner, the proportion of dispersed particles having a circle-equivalent diameter of 0.3 μm or more was 0.02%. A 5 μm thick toner layer of the resulting toner had an absorbance of 2.4.

A developer was prepared, and copying on OHP sheets was conducted in the same manner as in Example 1. The resulting images had a tendency of too strong coloring power.

When copying was effected on paper, the half tone of a dot image original proved to have deteriorated graininess.

COMPARATIVE EXAMPLE 4

A magenta toner was prepared in the same manner as in Example 1, except for using a magenta pigment dispersion which was prepared in the same manner as in Preparation Example 3, except for changing the heating temperature in a kneader to 90° C.

In the resulting magenta toner, the proportion of dispersed particles having a circle-equivalent diameter of 0.3 μm or more was 2.0%. A 5 μm thick toner layer of the resulting toner had an absorbance of 0.8.

A developer was prepared, and copying on OHP sheets was conducted in the same manner as in Example 1. The resulting image had a weak coloring power and was dull.

COMPARATIVE EXAMPLE 5

A magenta toner was prepared in the same manner as in Example 1, except for using a magenta pigment dispersion which was prepared in the same manner as in Preparation Example 3, except for changing the heating temperature and time in a kneader to 90° C. and 3 minutes.

In the resulting magenta toner, the proportion of dispersed particles having a circle-equivalent diameter of 0.3 μm or more was 1.3%. A 5 μm thick toner layer of the resulting toner had an absorbance of 0.9.

A developer was prepared, and copying was conducted in the same manner as in Example 1. The resulting image had a weak coloring power and was dull.

As clearly demonstrated above, the color toners according to the present invention give toner images excellent in brightness, clearness, and graininess and are therefore suitable for image formation on OHP sheets for projection. In particular, when the toner of the present invention is used as at least the uppermost layer of an overlapped toner layers composed of several color toners, for example, a magenta toner, a yellow toner, and a cyan toner to obtain a second-order or third-order color for formation of a distinct color image, particularly a Victorian full color image, the light reflected from the lower ink (toner) layer(s) is close to the reflected light characteristic of the pigment itself owing to the excellent transparency of the toner of the uppermost layer. As a result, a color having high saturation and showing no difference from a desired second-order or third-order color can be obtained.

While the invention has been described in detail and with reference to specific examples thereof, it will be apparent to one skilled in the art that various changes and modifications can be made therein without departing from the spirit and scope thereof.

What is claimed is:

1. A process for producing a color toner comprising a binder resin having dispersed therein pigment particles, wherein a proportion of dispersed pigment particles having a circle-equivalent diameter of 0.3 μm or greater does not exceed 0.1% of the total number of said dispersed pigment particles, the process comprising kneading a water-containing pigment paste and a binder resin at a temperature of 100° C. or higher under pressure in a heat kneader to remove a water content to obtain a pigment dispersion, melt-kneading the resulting pigment dispersion together with a binder resin, and grinding the mixture.

2. A process for producing a color toner as claimed in claim 4, wherein the time of kneading is at least 30 minutes.

3. A process for producing a color toner as claimed in claim 1, wherein the kneading is carried out at a temperature of from 100° to 110° C. for 50 to 200 minutes.

4. A color toner produced by the process of claim 1.

5. The color toner of claim 4, wherein the proportion of dispersed pigment particles having a circle-equivalent diameter of 0.3 μm or greater does not exceed 0.1% of the total said dispersed pigment particles.

6. The color toner of claim 4, wherein said color toner has a pigment content ranging from 2 to 8 parts by weight per 100 parts by weight of the binder resin and has an absorbance satisfying formula:

$$A \geqq 0.3B+0.1$$

wherein A is an absorbance; and B is a number of parts by weight of the pigment per 100 parts by weight of the binder resin.

7. The color toner of claim 4, wherein said color toner has a particle diameter of not more than 9 μm and has a pigment content ranging from 2 to 5.5 parts by weight per 100 parts by weight of the binder resin.

8. The color toner of claim 1, wherein the pigment particles are selected from the group consisting of C.I. Pigment Red 48:1, C.I. Pigment Red 122, C.I. Pigment Red 57:1, C.I. Pigment Yellow 97, C.I. Pigment Yellow 12, C.I. Pigment Yellow 17, C.I. Pigment Blue 15:1, and C.I. Pigment Blue 15:3.

9. A process for producing a color toner comprising a binder resin having dispersed therein pigment particles, wherein a proportion of dispersed pigment particles having a circle-equivalent diameter of 0.3 μm or greater does not exceed 0.1% of the total number of said dispersed pigment particles, the process comprising kneading a paste consisting essentially of pigment particles and water, and a binder resin at a temperature of 100° C. or higher under pressure in a heat kneader to remove a water content and obtain a pigment dispersion, melt-kneading the resulting pigment dispersion together with a binder resin, and grinding the mixture.

* * * * *

UNITED STATES PATENT AND TRADEMARK OFFICE

CERTIFICATE OF CORRECTION

PATENT NO. : 5,529,871

DATED : June 25, 1996

INVENTOR(S) : Masanori ICHIMURA et al.

It is certified that error appears in the above-indentified patent and that said Letters Patent is hereby corrected as shown below:

Claim 2, Column 12, line 12, "claim 4" should read --claim 1--.

Signed and Sealed this

Eighteenth Day of March, 1997

Bruce Lehman

*Attest:*

BRUCE LEHMAN

*Attesting Officer*

*Commissioner of Patents and Trademarks*